United States Patent [19]

Hori et al.

[11] 4,387,675

[45] Jun. 14, 1983

[54] ENGINE VALVE ACTUATING MECHANISM HAVING A HYDRAULIC FULCRUM LIFTING DEVICE

[75] Inventors: Takanobu Hori, Toyota; Fuminao Arai, Kariya; Hisashi Kodama, Nagoya; Yoshio Okabe, Kariya, all of Japan

[73] Assignee: Aisin Seiki Kabushiki Kaisha, Kariya, Japan

[21] Appl. No.: 227,919

[22] Filed: Jan. 23, 1981

[30] Foreign Application Priority Data

Jan. 28, 1980 [JP] Japan ..... 55-8608
Mar. 1, 1980 [JP] Japan ..... 55-25637

[51] Int. Cl.[3] ..... F01L 1/24
[52] U.S. Cl. ..... 123/90.58; 123/90.46; 123/90.55
[58] Field of Search ..... 123/90.46, 90.55, 90.57, 123/90.58, 90.56, 90.59

[56] References Cited

U.S. PATENT DOCUMENTS

| | | | |
|---|---|---|---|
| 2,737,934 | 3/1956 | Banker | 123/90.59 |
| 2,815,740 | 12/1957 | Slater | 123/90.55 |
| 3,025,842 | 3/1962 | Van Slooten | 123/90.58 |
| 3,799,129 | 3/1974 | Cornell | 123/90.46 |
| 3,805,753 | 4/1974 | Bergmann et al. | 123/90.46 |
| 3,875,908 | 4/1975 | Ayres | 123/90.36 |
| 4,184,464 | 1/1980 | Svihlik | 123/90.55 |

FOREIGN PATENT DOCUMENTS

| | | | |
|---|---|---|---|
| 54-141915 | 11/1979 | Japan | 123/90.57 |

*Primary Examiner*—Craig R. Feinberg
*Assistant Examiner*—W. R. Wolfe
*Attorney, Agent, or Firm*—Finnegan, Henderson, Farabow, Garrett & Dunner

[57] ABSTRACT

A hydraulic fulcrum lifting device for a valve actuating mechanism of an internal combustion engine in which the reservoir formed in the plunger is provided with a deflector encircling a port between the reservoir and a pressure chamber. The deflector functions to prevent air in the reservoir from being drawn through the port to the pressure chamber.

1 Claim, 7 Drawing Figures

ENGINE VALVE ACTUATING MECHANISM HAVING A HYDRAULIC FULCRUM LIFTING DEVICE

The present invention relates to a valve actuating mechanism for internal combustion engines and more particularly to a hydraulic lifting device for such valve actuating mechanisms.

In general, an internal combustion engine provided with an intake and exhaust valves has valve actuating mechanisms for cyclically actuating these valves. Such valve actuating mechanisms generally comprise a rocker arm supported by a fulcrum device for rocking movement and adapted at one end to be engaged with the valve for actuating the same. In order to actuate the rocker arm, there is provided a cam which is engaged with the rocker arm and adapted to be driven by the engine crankshaft. As the cam is driven by the engine crankshaft, the rocker arm is cyclically swung to thereby actuate the valve.

In this type of valve actuating mechanism, there is generally provided a so-called valve clearance between the rocker arm and the valve stem in order to compensate mostly for the difference in the thermal expansion between the engine cylinder and the valve actuating mechanism. If the valve clearance is not appropriately determined, it is difficult to ensure a satisfactory engine operation. For example, where the valve clearance is excessively large, so-called tappet noise is produced during the engine operation. If the valve clearance is in turn insufficient, the valve may fail to completely close so that there may be a possibility of gas leak which may cause a loss in the engine output.

In view of the above problems, there has been proposed to provide a hydraulic fulcrum lifting device so that the rocker arm is maintained always in contact with the valve stem and the aforementioned difference in the thermal expansion is absorbed by the lifting device. Such a hydraulic lifting device generally comprises a housing and a plunger which is slidably disposed in the housing for defining a pressure chamber and a reservoir which are connected together through a one-way check valve. The plunger has one end extending outwardly through the housing and providing a fulcrum for the rocker arm. In each cycle of the valve operation, the rocker arm is reciprocatingly swung by the cam to actuate the valve. When the rocker arm is forced downwards to open the valve, the reaction force applied to the fulcrum functions to force the plunger of the hydraulic lifting device into the housing to thereby increase the hydraulic pressure in the pressure chamber. The increase in the hydraulic pressure causes the one-way check valve to close. The pressure chamber is in communication with the reservoir through a leak clearance so that the hydraulic fluid in the pressure chamber is in part displaced through the leak clearance to the reservoir and the plunger is retracted by a predetermined distance in the valve opening stroke until the plunger abuts a plunger stop.

As the cam rotates further, the valve is moved to the closed position under the action of the valve return spring and the reaction force on the fulcrum is accordingly decreased. Thus, the plunger is forced outwardly under the hydraulic pressure in the pressure chamber and the action of a return spring which may be provided for the purpose. In this course of the plunger movement, the one-way check valve may be opened to provide a supply of hydraulic fluid from the reservoir to the pressure chamber.

In this type of hydraulic fulcrum lifting device, the plunger is provided with an air vent passage which leads from the oil reservoir to open the reservoir to the atmosphere. Where the hydraulic oil used in the lifting device is different from the engine oil, there is a possibility that the engine oil be admitted into the reservoir through the air vent passage. Such engine oil admitted into the reservoir will be mixed with the hydraulic oil causing the hydraulic oil to deteriorate. Further, the engine oil admitted into the pressure chamber has an adverse effect on the function of the lifting device. A further problem in this type of fulcrum lifting device is that when the hydraulic oil is moved from the reservoir to the pressure chamber, air is drawn with the oil into the pressure chamber causing an air drawing noise.

It is therefore an object of the present invention to provide a hydraulic type fulcrum lifting device which has means for preventing engine oil from being drawn into the pressure chamber.

Another object of the present invention is to provide a hydraulic fulcrum lifting device in which air drawing noise can be eliminated.

A further object of the present invention is to provide a hydraulic fulcrum lifting device with means for preventing oil leakage when the device is removed from the engine.

According to the present invention, in order to accomplish the above and other objects, there is provided a hydraulic type fulcrum lifting device for a valve actuating mechanism of an internal combustion engine, said device comprising a hollow housing having a bottom wall, a plunger disposed in said housing for reciprocating movement, said plunger having an inner end for defining a pressure chamber in the housing between said bottom wall and the inner end of the plunger, said plunger further having an outer end extending outwardly beyond the housing and providing a fulcrum for a rocker arm of the valve actuating mechanism, a reservoir communicated with said pressure chamber through port means in said inner end of the plunger, check valve means provided in said port means and adapted to open only toward said pressure chamber, and deflector means provided in said reservoir to encircle said port means and having opening means so that oil is passed through said opening means to said port means. According to the feature of the present invention, the deflector means functions to prevent air from being drawn through the port means to the pressure chamber.

In a preferable aspect of the present invention, the deflector means has an annular wall spaced apart from a wall surface of the reservoir and the opening means includes a plurality of openings formed in the annular wall. According to a further aspect of the present invention, the plunger is formed with passage means for opening the reservoir to the atmosphere and means is provided for automatically closing the passage means to prevent oil leakage from the reservoir when the device is not installed on the engine. In one mode of the present invention, the passage means may be formed with air vent port means which is adapted to be closed when the plunger is shifted to the fully extended position. A spring bias means may be provided to force the plunger to the extended position. Alternatively, the plunger may be provided with a valve which is adapted to be shifted to a closed position under its own weight when the device is laid horizontally or in an inverted position.

The above and other objects and features of the present invention will become apparent from the following descriptions of preferred embodiments with reference to the accompanying drawings, in which.

Figure 1:
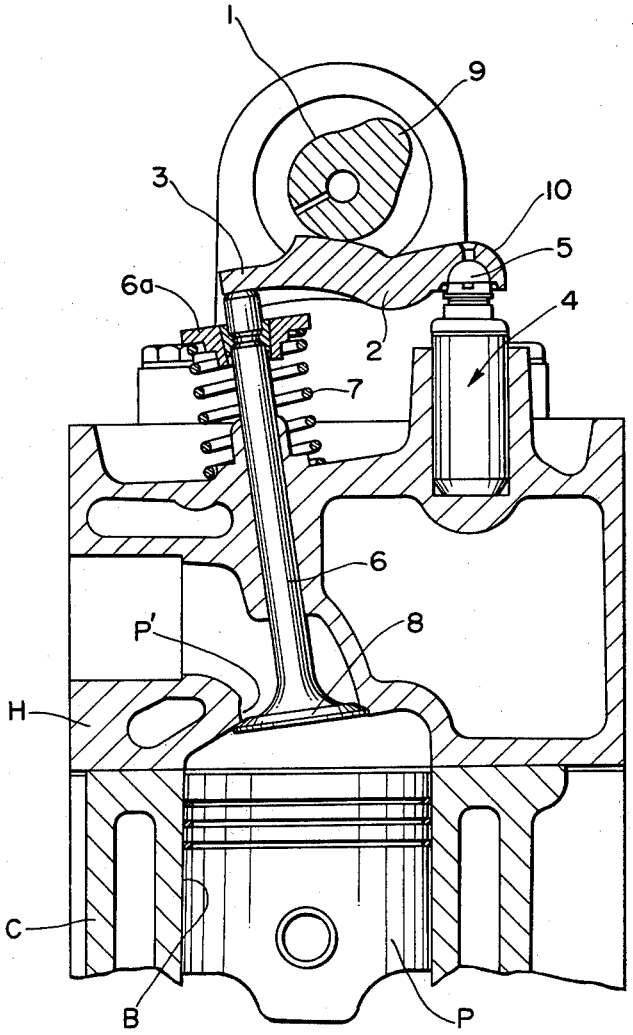
FIG. 1 is a sectional view of an engine valve actuating mechanism having a hydraulic type fulcrum lifting device to which the present invention can be applied.

Referring now to the drawings, particularly to FIG. 1, there is shown an internal combustion engine comprised of a cylinder block C having a cylinder bore B and a cylinder head H. In the cylinder bore B of the cylinder block C, there is disposed a piston P which is slidable in the cylinder bore B. In the cylinder head H, there is a port P' which may be either an intake port or an exhaust port. Although not shown in the drawing, there is formed another port in the cylinder head H as well known in the art.

In the port P', there is provided a valve member 8 for cooperation therewith. The valve member 8 has a valve stem 6 which extends upwardly beyond the cylinder head H and has a valve retainer 6*a* at the upper end portion thereof. A compression coil spring 7 is provided between the valve retainer 6*a* and the cylinder head H so as to force the valve member 8 upwardly to the closed position. In order to actuate the valve member 8, there is provided a rocker arm 2 which is supported for pivotable movement at one end portion 10 by a fulcrum 5 and engaged at the other end portion 3 with the upper end of the valve stem 6. A cam 1 having a cam lobe 9 engages the rocker arm 2 so that the rocker arm 2 is cyclically swung in response to a rotation of the cam 1 to thereby cyclically actuate the valve member 8 to an open position. In order to eliminate the valve clearance, the fulcrum 5 is provided by a hydraulic fulcrum lifting device 4 which will hereinafter be described in detail.

Figure 2:
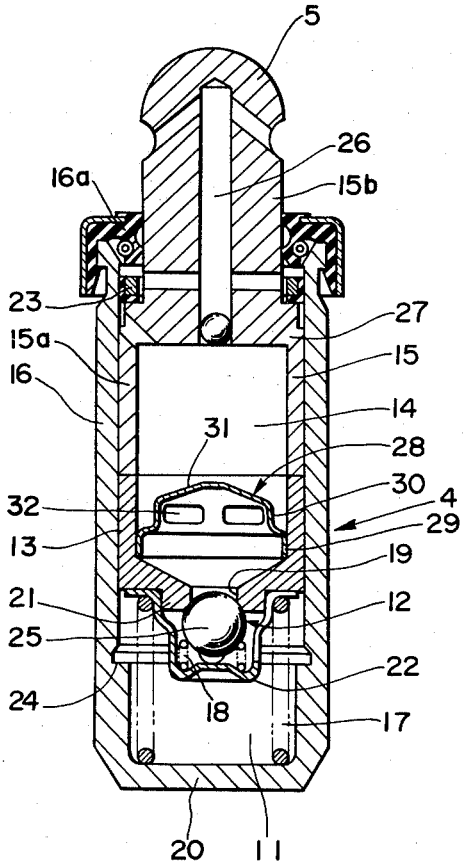
FIG. 2 is a sectional view of a fulcrum lifting device in accordance with one embodiment of the present invention.

Referring now to FIG. 2, the hydraulic fulcrum lifting device 4 includes a cylindrical housing 16 having a bottom wall 20 and an open top which is closed by a rubber cap 16*a*. In the housing 16, there is disposed a plunger 15 for axial reciprocating movement. As shown in FIG. 2, the plunger 15 has a hollow body portion 15*a* which slides along the inner wall surface of the housing 16 and a stem portion 15*b* which extends outwardly through the rubber cap 16*a*. The aforementioned fulcrum 5 is formed at the outer end of the stem portion 15*b* of the plunger 15.

In the hollow body portion 15*a* of the plunger 15, there is a chamber providing an oil reservoir 14. The hollow body portion 15*a* has a bottom wall 21 and a pressure chamber 11 is defined in the housing 16 between the bottom wall 20 of the housing 16 and the bottom wall 21 of the hollow body portion 15*a* of the plunger 15. The bottom wall 21 of the plunger 15 is formed with a port 19 connecting the pressure chamber 11 to the reservoir 14 and a one-way check valve 12 is associated with the port 19.

The check valve 12 comprises a ball or valve member 25 for cooperation with the port 19 and a valve spring 18 which functions between a spring retainer 22 and the ball 25 to force the ball 25 toward the port 19 to close the same. Thus, the check valve 12 is normally closed and opens only toward the pressure chamber 11. In the pressure chamber 11, there is provided a compression spring 17 which acts between the bottom wall 20 of the housing 16 and the bottom wall 21 of the plunger 15 to force the plunger 15 outwardly to an extended position. A stop ring 24 is provided in the pressure chamber 11 adapted for engagement with the bottom wall 21 of the plunger 15 to limit the stroke of the inward movement of the plunger 15. At the upper end portion of the housing 16, there is an annular stop member 23 which is adapted for engagement with a shoulder portion formed at the upper end of the hollow body portion 15*a* of the plunger 15 to limit the stroke of the upward or outward movement of the plunger 15.

The plunger 15 is formed at the upper shoulder portion of the hollow body portion 15*a* with passages 27 for opening the reservoir 14 to a space formed in the housing 16 above the hollow body portion 15*a* of the plunger 15. Between the inner wall surface of the housing 16 and the hollow body portion 15*a* of the plunger 15, there is a small clearance 13 so that a restricted return path is provided between the pressure chamber 11 and the reservoir 14 by the clearance 13 and the passages 27. The stem portion 15*b* of the plunger 15 is formed with an air vent passage 26 which opens on one end to the atmosphere in the vicinity of the fulcrum 5 and on the other hand to the peripheral surface of the stem portion 15*b* in the vicinity of the lower end portion thereof so that the space above the hollow body portion 15*a* is opened to the atmosphere when the plunger 15 is in a retracted position. When the plunger 15 is in the fully extended position as shown in FIG. 2, the stop member 23 functions to block the communication between the passage 26 and the space above the hollow body portion 15*a*.

In the reservoir 14, there is provided a deflector 28 which encircles the port 19. The deflector 28 includes a lower annular wall 29 which is adapted to be fitted to the wall surface of the reservoir 14 and an upper annular wall 30 which is spaced apart from the wall surface of the reservoir 14. A substantially conical top 31 is provided above the upper wall 30. The upper annular wall 30 is formed with openings 32.

In operation, as the cam 1 rotates, the lobe 9 thereof cyclically engages the rocker arm 2 to force it downwardly so that the rocker arm 2 is cyclically swung about the fulcrum 5 to push the valve stem 6 to the open position. When the rocker arm 2 is thus forced downwards by the cam lobe 9, a downwardly directed force is applied also to the fulcrum 5 so that the plunger 15 is forced to the retracted position. The check valve 12 is then closed and the pressure in the chamber 11 is increased. The hydraulic fluid in the chamber 11 is allowed to pass through the restricted path provided by the clearance 13 and then through the passages 27 to the reservoir 14 so that the plunger 15 is moved downwardly until it engages the stop ring 24. As the cam lobe 9 moves away from the rocker arm 2, the force which has been applied to the fulcrum 5 is relieved so that the plunger 15 is moved upwardly under the influence of the spring 17. In this instance, the check valve 12 is opened and the hydraulic fluid is drawn from the reservour 14 to the pressure chamber 11. In the structure described above, the deflector 28 provided in the reservoir 14 functions to exclude air from the inside of the deflector 28. It is therefore possible to prevent air from being drawn through the port 19 to the pressure chamber 11. Further, even when the engine oil is admitted through the passages 26 and 27 to the reservoir 14, the engine oil is accummulated above the hydraulic oil due to a difference in the density so that the engine oil is not allowed to enter the inside of the deflector 28. It should further be noted that, in the illustrated structure, when the lifting device 4 is removed from the engine, the plunger 15 is shifted under the influence of the spring 17 to the fully extended position where the passage 26 in the stem portion 15*b* is disconnected by the stop member 23 from the space above the hollow body portion 15*a* of the plunger 15. Therefore, it is possible to prevent leakage of hydraulic oil contained in the lifting device 4.

Figure 3:
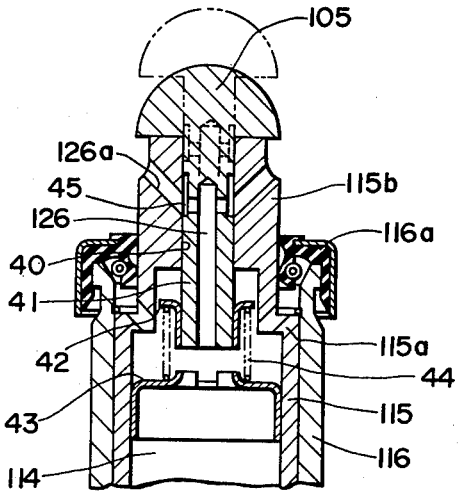
FIGS. 3 through 7 are fragmentary sectional views showing different embodiments.

Referring now to FIG. 3, the lifting device 104 shown therein includes a cylindrical housing 116 and a plunger 115 which has a hollow body portion 115*a* and a stem portion 115*b*. The housing 116 has an upper end closed by an end rubber cap 116*a*. In the plunger 115, there is defined a reservoir 114 as in the previous embodiment. It should be understood that the lower part of the lifting device 104 is constructed in a similar manner as in the previous embodiment.

In the embodiment shown in FIG. 3, the stem portion 115*b* of the plunger 115 is formed with an axial bore 40 which slidably receives a fulcrum rod 41. The rod 41 has an end located in the reservoir 114 and fitted with a spring retainer 42. The other end of the rod 41 projects outwardly from the stem portion 115*b* and is formed with a part-spherical fulcrum 105. A spring retainer 43 is provided in the reservoir 114 and a spring 44 acts between the spring retainers 42 and 43 to force the rod 41 outwardly.

In the rod 41, there is formed a passage 126 which opens at one end to the reservoir 114 and at the other end to the outer surface of the rod 41 through ports 45. The stem portion 115*b* of the plunger 115 is formed with passages 126*a* which are so located that they are communicated with the ports 45 in the rod 41 when the rod 41 is moved axially inwardly against the function of the spring 44 but disconnected from the ports 45 when the rod 41 is moved outwardly as shown by phantom lines in FIG. 3. Thus, it will be understood that when the lifting device 104 is removed from the engine, the fulcrum rod 41 is shifted outwardly to the position shown by phantom lines in FIG. 3 so that the passage 126 and therefore the reservoir 114 is disconnected from the atmosphere. When the lifting device 104 is installed on the engine, the fulcrum rod 41 is moved axially inwardly to the position shown by solid lines in FIG. 3 so that the reservoir 114 is opened to the atmosphere through the passages 126 and 126*a*.

Figure 4:
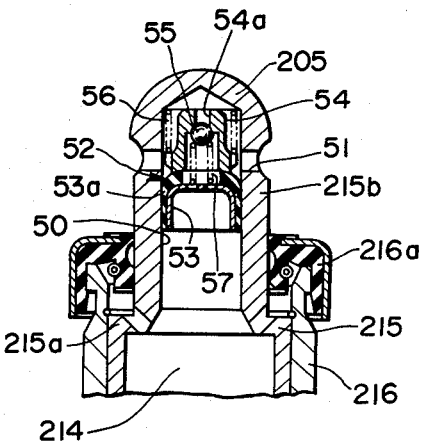

In FIG. 4, there is shown another embodiment of the present invention. In this embodiment, the plunger 215 has a hollow body portion 215*a* and a stem portion 215*b* which projects through an end cap 216*a* on a housing 216 and is formed at the outer end with a fulcrum 205. The stem portion 215*b* of the plunger 215 is formed with an axial bore 50 and radial ports 51 to open the reservoir 214 to the atmosphere. In the axial bore 50 of the stem portion 215*b*, there is provided a breathing check valve 52 which comprises a valve retainer 53 having a seat member 53*a* and a valve seat member 54 having a valve hole 54*a*. A ball or valve member 55 is provided for cooperation with the valve hole 54*a*.

A spring 56 is provided for forcing the valve seat member 54 toward the retainer 53 to seat on the seat member 53*a*. A second spring 57 is provided between the ball 55 and the retainer 53 to force the ball 55 toward the hole 54*a* to close the same. Thus, the valve 52 is normally closed to prevent oil leakage, however, when there is a decrease in pressure in the reservoir 214, the ball 55 is moved apart from the valve seat member 54 to open the hole 54*a* so that air is introduced into the reservoir 214. When there is an excessive increase in the pressure in the reservoir 214, the valve seat member 54 is displaced from the member 53*a* to relieve the pressure in the reservoir 214.

Figure 5:
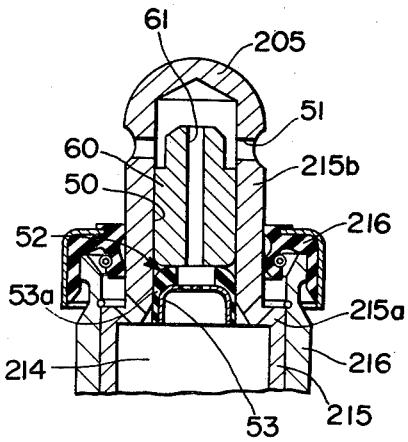

Referring now to FIG. 5, there is shown a modification of the structure shown in FIG. 4. In FIG. 5, corresponding parts are therefore designated by the same reference numerals as in FIG. 4. In this embodiment, there is provided in the axial bore 50 of the stem portion 215*b* a valve member 60 having an axial hole 61. In normal upright position of the lifting device, the valve member 60 is seated on the seat member 53*a* so that the reservoir 214 is opened to the atmosphere through the axial hole 61 in the valve member 60 and the radial holes 51. However, when the lifting device is removed from the engine and place for example in an inverted position, the valve member 60 is slidably moved in the bore 50 to close the holes 51. Thus, oil leakage can be effectively prevented.

Figure 6:
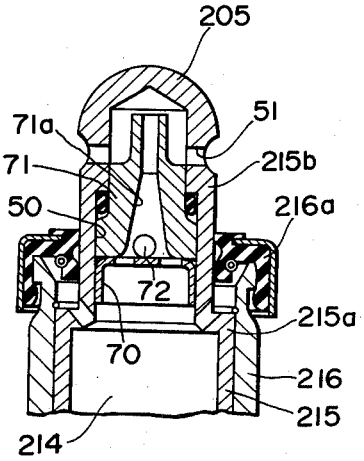

In FIG. 6, the embodiment shown therein has a valve seat member 71 held by a valve retainer 70 in the axial bore 50 of the stem portion 215*b*. The seat member 71 has an axial tapered hole 71*a* which connects the reservoir 214 to the radial holes 51. A ball or valve member 72 is provided for cooperation with the tapered hole 71*a*. In normal position of the lifting device, the ball 72 is held apart from the wall surface of the tapered hole 71*a* so that the reservoir 214 is opened to the atmosphere through the tapered hole 71*a* and the radial holes 51. However, when the lifting device is removed from the engine and placed for example in an inverted position, the ball 72 closes the hole 71*a* to thereby prevent oil leakage.

Figure 7:
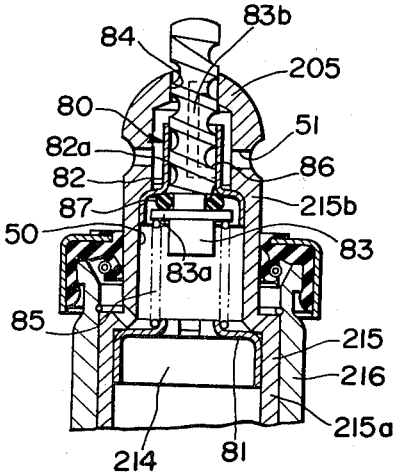

In FIG. 7, the embodiment shown therein includes a valve 80 provided in the axial bore of the stem portion 215*b* to control communication between the radial holes 51 in the stem portion 215*b* and the reservoir 214. The valve 80 includes a spring retainer 81 fixed to the plunger 215 at the upper end portion of the reservoir 214 and a valve retainer 82 fitted to the stem portion 215*b* at the axial bore 50. A valve member 83 extends through the valve retainer 82 and a hole 84 formed in the fulcrum 205 to project beyond the fulcrum 205. At the lower portion, the valve member 83 is provided with a flange 83*a* and a spring 85 is disposed between the spring retainer 81 and the flange 83*a* to force the valve member 83 upwardly. The valve member 83 has a stem 83*b* which extends through a cylindrical portion 82*a* of the valve retainer 82 and is formed with a spiral groove 86 so that the reservoir 214 is communicated with the radial holes 51 in the stem portion 215*b* of the plunger 215. An O-ring seal 87 is provided between the flange 83*a* of the valve member 83 and the valve retainer 82. Thus, when the valve member 83 is forced upwardly under the influence of the spring 85, the O-ring seal 87 blocks the communication between the reservoir 214 and the radial holes 51. In this position, the O-ring seal 87 therefore prevents oil leakage. However, when the lifting device is installed on the engine, the valve member 83 is pushed inwardly by the rocker arm so that the O-ring seal 87 is removed from the sealing contact with the valve retainer 82 and the flange 83*a* of the valve member 83. Thus, the reservoir 214 is opened to atmosphere.

The invention has thus been shown and described with reference to specific embodiments, however, it should be noted that the invention is in no way limited to the details of the illustrated structures but changes and modifications can be made without departing from the scope of the appended claims.

We claim:

1. A hydraulic fulcrum lifting device for a valve actuating mechanism of an internal combustion engine, said device comprising:

a hollow housing having a bottom wall and an open top end;

a plunger disposed in said housing for reciprocating movement, said plunger having an outer end extending outwardly through the open end of the housing and providing a fulcrum for a rocker arm of the valve actuating mechanism, said plunger being subjected to an outward biasing force of a spring;

a pressure chamber in the housing defined between said bottom wall and an inner end of the plunger;

a reservoir chamber in said plunger communicated with said pressure chamber through port means in said inner end of the plunger;

check valve means provided in said port means and adapted to open only toward said pressure chamber;

passage means formed in said plunger for opening the reservoir chamber to the atmosphere;

an annular stop member disposed proximate the open end of said housing and adapted to engage a shoulder portion of said plunger so as to limit the outward stroke of said plunger and to close said passage means when the device is not installed in the engine; and deflector means provided in said reservoir chamber to encircle said port means and adapted to be fitted to the inside wall surface of said reservoir, said deflector means including a stop wall spaced from said port means, an annular side wall substantially parallel to and spaced from the inside wall surface of said reservoir, and opening means in said annular side wall permitting fluid communication between said reservoir and said port means.

* * * * *